US006971558B2

(12) United States Patent
Ramsey et al.

(10) Patent No.: US 6,971,558 B2
(45) Date of Patent: Dec. 6, 2005

(54) ENERGIZING RING FOR A CLOSURE MEMBRANE

(75) Inventors: Christopher Paul Ramsey, Oxfordshire (GB); Martin John Watson, Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 246 days.

(21) Appl. No.: 10/333,840

(22) PCT Filed: Jul. 19, 2001

(86) PCT No.: PCT/EP01/08338

§ 371 (c)(1),
(2), (4) Date: Jan. 24, 2003

(87) PCT Pub. No.: WO02/08080

PCT Pub. Date: Jan. 31, 2002

(65) Prior Publication Data

US 2004/0040987 A1 Mar. 4, 2004

(30) Foreign Application Priority Data

Jul. 24, 2000 (EP) ..... 00306281

(51) Int. Cl.[7] ..... B65D 25/04
(52) U.S. Cl. ..... 222/492; 222/212
(58) Field of Search ..... 222/212, 490, 222/492, 494

(56) References Cited

U.S. PATENT DOCUMENTS 5,842,618 A * 12/1998 Julemont et al. ..... 222/490
5,897,033 A * 4/1999 Okawa et al. ..... 222/212
6,095,381 A * 8/2000 Schwanenberg ..... 222/490

FOREIGN PATENT DOCUMENTS

| | | |
|---|---|---|
| DE | 35 31 783 A1 | 9/1985 |
| DE | 196 12 561 A1 | 3/1996 |
| DE | 196 13 130 A1 | 4/1996 |
| EP | 0 545 678 B1 | 2/1998 |
| WO | WO 99/10247 | 3/1999 |
| WO | WO 00/29296 | 5/2000 |

* cited by examiner

*Primary Examiner*—Michael Mar
*Assistant Examiner*—Melvin A. Cartagena
(74) *Attorney, Agent, or Firm*—Diller, Ramik & Wight

(57) ABSTRACT

A closure for a container, which has a self-closing valve having a cup-shaped valve head (32) with a dispensing aperture defined therein. In response to increased pressure in the container, the head of the self-closing valve to flatten and partially invert, thereby opening the dispensing aperture (6). The closure (1) includes an energizing ring (5) arrange surrounding the valve head (32) and adapted to restrict the radial expansion thereof. The position and design of the energizing ring (5) relative to the valve head (32) may be adjusted to affect the performance of the valve allowing a single valve design to be used for a number of different applications. Alternatively the energizing ring (5) may be used to improve the performance of a particular design of valve.

13 Claims, 3 Drawing Sheets

ENERGIZING RING FOR A CLOSURE MEMBRANE

BACKGROUND OF THE INVENTION

The present invention relates to dispensing closures for packaging containers and in particular to closures which include a self-closing valve. The invention proposes a means for controlling the opening and closing characteristics of the valve, independently of the design of the self-closing valve itself.

A dispensing closure having a self-closing valve is disclosed in our PCT patent publication No. WO99/10247 (Agents Ref: 4981 WO). The self-closing valves described in this document have a valve head attached by a flexible connecting wall to a mounting ring. The valve is mounted in the dispensing closure by engagement of the mounting ring in a valve seat. The valve head is essentially cup-shaped, having an upstanding peripheral rim surrounding a concave central region. A dispensing aperture is defined by crossed slits in this central region. The slits are cut or moulded in the material of the head. The crossed slits define resilient tongues which are capable of sealing with one another along the slit edge when the valve is in its "at rest" position.

Increased product pressure in the container (caused by a user squeezing the container, for example), causes the valve head to deform outwardly (away from the interior of the container) and partially invert, causing the slits to gape open to allow product to be dispensed from the container. On release of the product pressure, the valve head reverts back to its concave, essentially cup-shaped configuration and the resilient tongues reseal along the slit edge, allowing air to vent into the container where necessary.

In order to meet the various requirements imposed on them, self-closing valves have conventionally been made from a material having advanced physical properties, in particular flexibility and resilience. Liquid silicon has been particularly preferred for this purpose although thermoplastic elastomers have also been considered. It has been necessary to optimise the design of the self-closing valve (particularly the shape and configuration of the valve head and the connecting wall) to ensure satisfactory opening and self-closing characteristics. Thus, generally the performance of the valve has had to be controlled by the material selection and design of the valve.

EP 0 545 678 describes a self-closing valve having a cup-shaped valve head and a mounting ring, joined by a flexible connecting wall, which takes the form of a rolling diaphragm. This document discusses the design considerations that need to be addressed to produce a satisfactory self-closing valve. In particular, the need to obtain a sharp "flip" of the valve between its closed, concave configuration and its open, partially inverted configuration. This "flip" ensures that the valve snaps open and closed rather than having a smooth transition between the open and closed positions.

EP 0 545 678 discusses the importance of valve geometry and material selection when trying to obtain a satisfactory "flip" or snap action. In particular, this document describes how the geometry of the valve disclosed, provides torque assist to the "flip" action of the valve head The design of the valve head, connector sleeve and connection between the two is designed to increase the outwardly directed torque applied to the valve head to "flip" it between its fully closed and fully open positions.

However, the silicon based material, conventionally used to produce such self-closing valves, is expensive and therefore, different valve designs and materials have been tried in order to minimise the amount of material used or to produce a valve from a cheaper materials, often with less advanced physical properties. Such designs and materials may produce a functional but less desirable valve. Unfortunately, the "flip" action of the valve head is often compromised in such designs.

SUMMARY OF THE INVENTION

Therefore, it is an aim of the present invention to control or enhance the performance of a self-closing valve independently of the design of the valve itself. In particular, it is an aim of the present invention to affect or improve the performance of the valve by interaction between the valve housing and the valve. Thus, the performance of a low cost valve, using less material for example, can be improved by modification of the valve housing. The housing is usually injection moulded from a thermoplastic material and is therefore relatively straightforward to modify.

Accordingly, the present invention provides a closure for a packaging container, which has a self-closing valve having a flexible, essentially cup-shaped valve head with a dispensing aperture defined therein, the valve head adapted to flatten and partially invert in response to increased product pressure in the container, to open the dispensing aperture, characterised in that the closure has an energizing ring arranged surrounding the valve head and adapted to restrict the radial expansion thereof, which normally accompanies the flattening and partial inversion of the valve head.

The inventors have discovered that the "flip" of the valve head, can be affected by supporting the periphery of the valve head or a portion of the flexible connecting wall, as the valve head partially inverts. Thus, the "flip" of the valve head can be controlled by constraining the radial expansion of the valve head as the dispensing aperture opens. This can most easily be achieved by providing an energizing ring surrounding the valve head, which either acts directly on the valve head or on the connecting wall between the valve head and the mounting ring, such that it restricts the radial expansion of the valve head as it partially inverts, producing a more definite "flip" as discussed above. The contact between the valve head or connecting wall and the energizing ring also acts to energise the head as the dispensing aperture opens, generating a spring bias to return the valve head to its concave position, thereby snapping the dispensing aperture to its closed position, once the internal pressure of the product in the container is released. This ensures that the self-closing valve has the positive shut off preferred by consumers.

An advantage of the energizing ring is that it can be moulded as part of the closure or valve housing and can be easily modified independently of the self-closing valve. This allows the valve performance to be optimised by adjusting the design and position of the energizing ring rather than modifying the design of the self-closing valve. Thus, the cost of developing and optimising the design of the closure is greatly reduced.

Another advantage of the invention is that it allows a single design of self-closing valve to be used for a number of different applications having different requirements for valve performance. The valve performance for each application can be optimised by varying the position and design of the energizing ring. For example: The degree of radial compression applied to the valve head by the energizing ring effects the threshold pressure at which the valve will open. The axial position of the energizing ring with respect to the valve head affects the amount of torque assist provided to partially invert the valve head. Finally, the combination of radial compression and axial position of the energizing ring with respect to the valve head varies the "flip" action of the valve head. Thus, the energizing ring may be used to bias the valve head, to control the threshold pressure at which the dispensing aperture opens, the pressure at which the valve self-closes and thereby control the dose of product dispensed from the container.

Alternatively, instead of applying radial compression to the valve head, the energizing ring may be spaced from the valve head or connecting wall by a clearance distance, which is limited by the need to ensure that the valve makes contact with the energizing ring before the dispensing aperture snaps open. This arrangement ensures that the axial movement of the valve head is unhindered but the contact between the valve and the energizing ring as the valve head expands radially, provides torque assist to partially invert the valve head at the end of its axial movement.

Preferably, the energizing ring is provided as an integral part of the closure body. In many closure designs, such as those described in WO99/10247, the mounting ring of the self-closing valve is received in a valve seat defined in the valve housing and the valve is retained therein by a retaining ring or clip. In this arrangement, the retaining ring is preferably adapted to define the energizing ring. Advantageously, the energizing ring may be provided as a separate component, which engages in a recess in the valve housing. This arrangement has the advantage that the same design of closure and self-closing valve may be used for a number of different applications, with only the design of the energizing ring having to be adapted for each application. The invention will now be described, by way of example only, with reference to the accompanying drawings, in which:

DETAILED DESCRIPTION OF THE PREFERRED EMBODIMENTS

Figure 1:
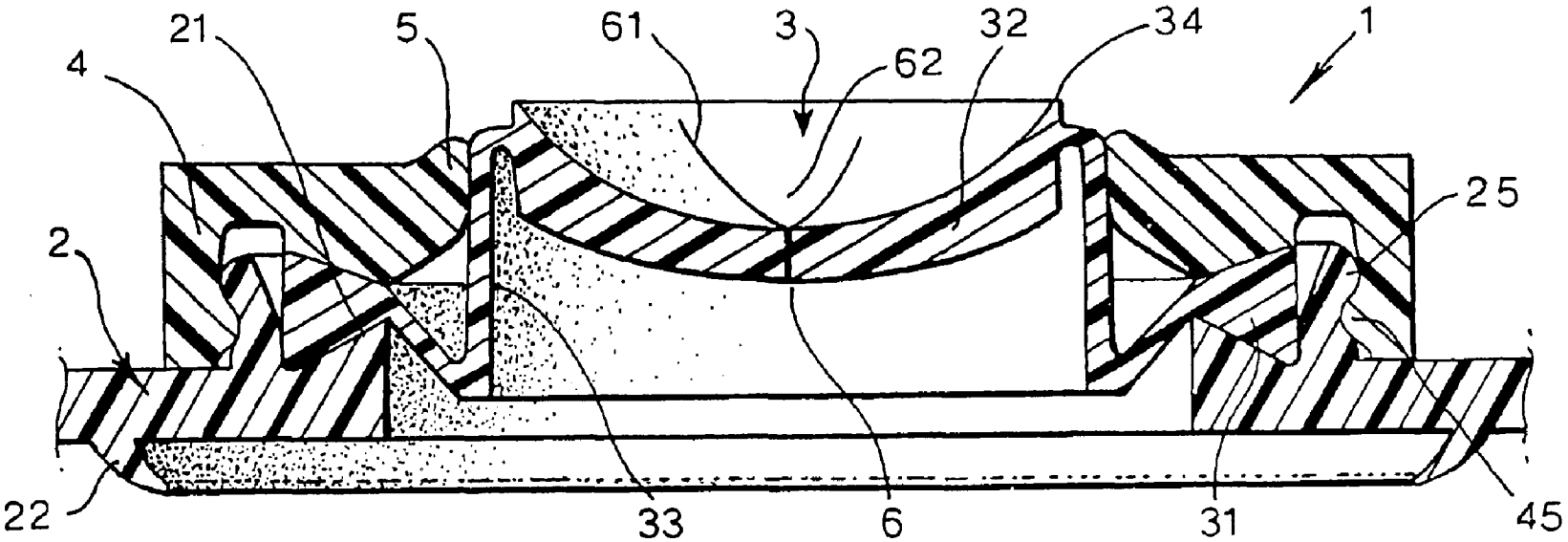
FIG. 1 shows a section through the middle of a first self-closing valve retained in a valve seat by a retaining clip, which defines an energizing ring. The self-closing valve is shown in its "at rest" or closed position.

Referring to FIG. 1, a dispensing closure 1 according to the invention comprises a closure body 2, which defines a valve seat 21 and has a sealing lip 22 for sealing against the mouth of a container (not shown). The closure further comprises a self-closing valve 3 comprising a mounting ring 31 connected to a valve head 32 via a flexible connecting wall 33. The point of connection between the valve head 32 and the flexible connecting wall 33, acts as a hinge 35 about which the valve head pivots as it "flips" to its partially inverted configuration. The valve head 32 is generally cup shaped, having an upstanding peripheral rim 34 surrounding a concave central region (not referenced for reasons of clarity). A dispensing aperture 6 is provided by crossed slits 61, which define resilient tongues 62 which seal along the slits 61 when the valve is in its "at rest" position.

The self-closing valve 3 is mounted in the valve seat 21 defined in the closure body, the mounting ring 31 and valve seat 21 being shaped such the mounting ring 31 sits neatly in the valve seat 21. The mounting ring 31 is held in position in the valve seat 21 by means of a retaining clip 4. The retaining clip 4 and closure body 2 have mutually engaging snap beads 45, 25 arranged to hold the retaining clip 4 and body 2 together, with the valve mounting ring 31 constrained between opposing surfaces of the retaining clip 4 and the valve seat 21. A portion of the retaining clip 4 is adapted to form an energizing ring 5 which takes the form of an annulus, surrounding the valve head 32. The energizing ring 5 is arranged to make contact with the valve connecting wall 33, below the hinge 35, when the valve 3 is in its "at rest" or closed position.

Figure 2A:
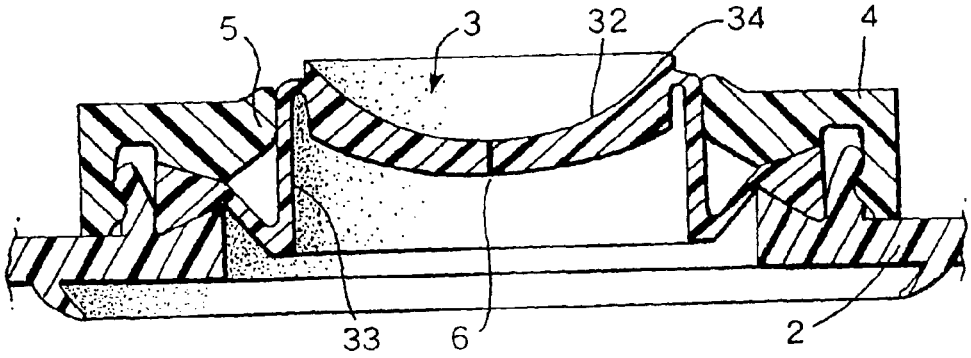
FIGS. 2A to 2C show cross sectional views through the valve of FIG. 1 when it is in its "at rest" or closed position, activated position and open position respectively.
Figure 2B:
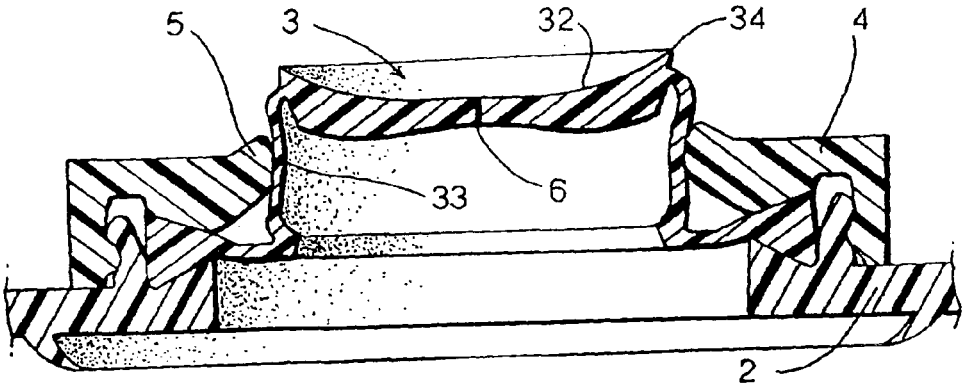
Figure 2C:
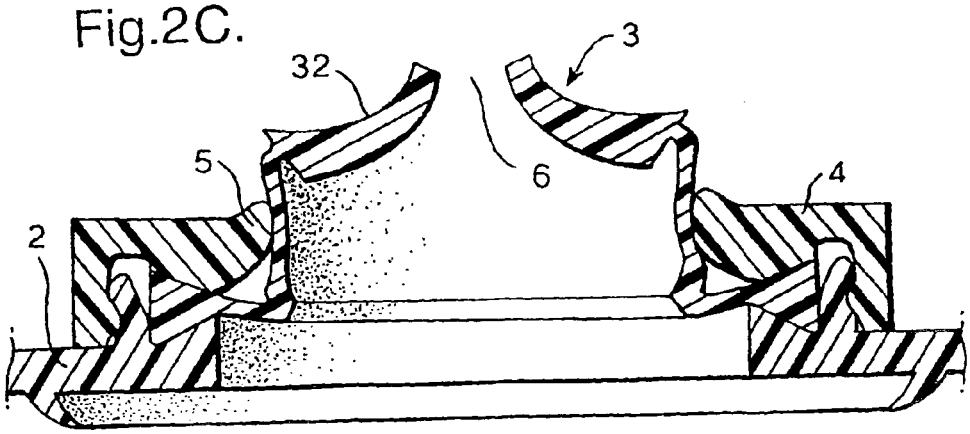

FIGS. 2A to 2C show the valve at various stages during its opening movement. FIG. 2A corresponds to FIG. 1 and shows the valve in its "at rest" or closed position. When the internal pressure in the container increases (by a user squeezing the container, for example) the valve 3 begins to move axially by extension of the connecting wall 33 but is restricted somewhat by the frictional contact between the energizing ring 5 and the connecting wall 33. As shown in FIG. 2B, the valve 3 also tries to expand radially outwards but is again restricted by the energizing ring 5, producing a bow in the connecting wall 33. The stresses in the connecting wall 33, caused by it pressing against the energizing ring 5, provides torque assist to "flip" the valve head 32 from its generally concave, closed configuration to its partially inverted, open configuration, as shown in FIG. 2C.

Referring to FIG. 2C, the pressure of the energizing ring 5 against the connecting wall 33 also energises the connecting wall 33, so that when the internal pressure in the container is relieved, the valve head 32 snaps back to its concave position, sealing the dispensing aperture 6 closed and providing a positive cut off to the product being dispensed.

Figure 3A:
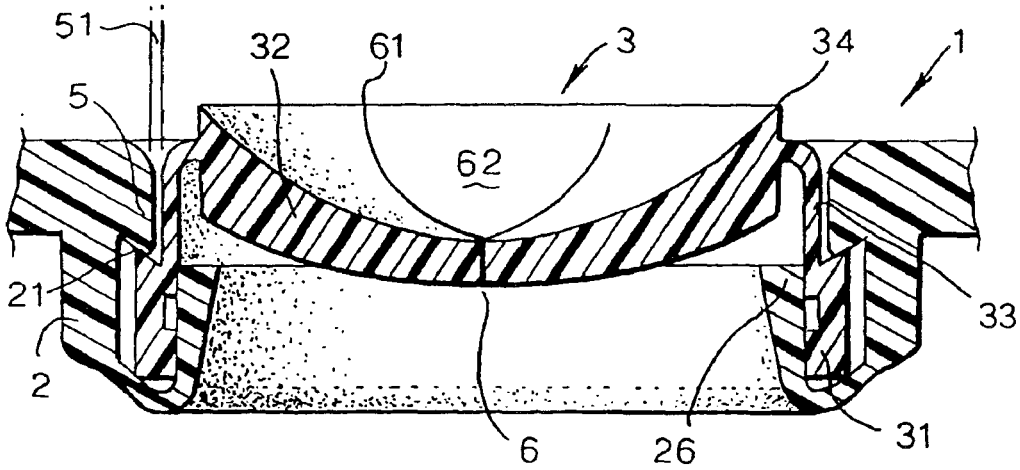
FIGS. 3A and 3B show cross sectional views through a second self-closing valve in its "at rest" or closed position and in its open position respectively. The valve is retained in a housing, which is adapted to define an energizing ring.
Figure 3B:
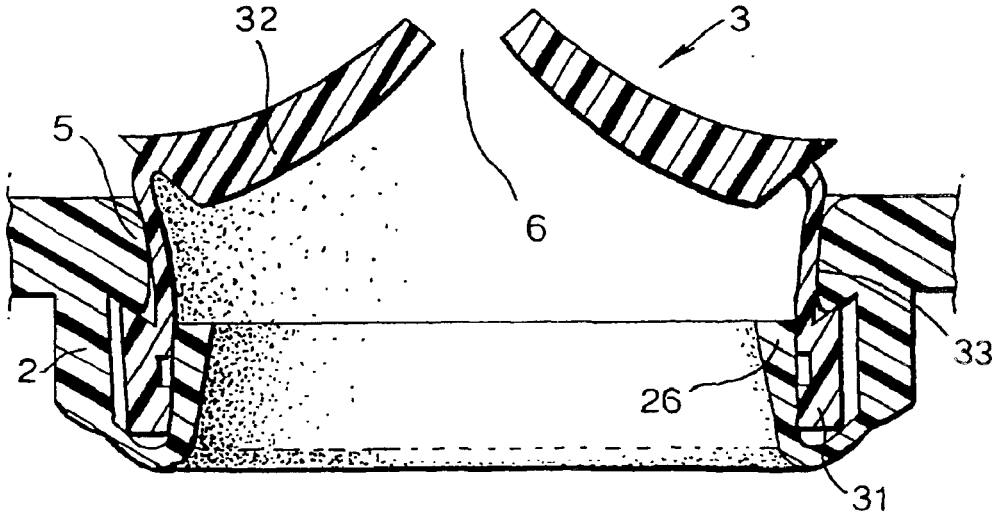

FIGS. 3A and 3B show an alternative dispensing closure 1 having a self-closing valve 3, which is retained in the closure body 2 by means of an upturned flange 26 on the closure body, which forces the mounting ring 31 of the valve against a sealing surface 21 on the closure body 2. Again, the self-closing valve 3 comprises a generally concave, cup-shaped valve head 32, connected to a mounting ring 31 by a flexible connecting wall 33. The valve head 32 is connected to the flexible connecting wall 33 via a hinge portion 35. However, in this valve arrangement, the flexible connecting wall 33 is designed for minimum axial movement. The valve head 32 moves axially by a small amount by stretching of the connecting wall 33 but there is no folded structure, which unfolds to allow significant axial movement.

In this arrangement, the energizing ring 5 is defined by a portion of the closure body 2. Referring to FIG. 3A, the energizing ring 5 may be arranged so that it does not contact the connecting wall 33, when the valve 3 is in its "at rest" position. Rather, the energizing ring 5 is spaced from the connecting wall 33 by a clearance distance 51, which is selected such that the energizing ring 5 does not restrict axial movement of the valve head 32 but does make contact with the connecting wall 33 as the valve head 32 and connecting wall 33 expand radially outwards, restricting the movement thereof and providing the torque assist to "flip" the valve head to its partially inverted, open position, as previously described. It will be appreciated that a clearance gap may also be provided in the arrangement shown in FIGS. 1 and 2. Equally, the energizing ring 5 shown in FIG. 3A may be arranged to contact the connecting wall 33, below the hinge portion 35 in the same way as described in relation to FIGS. 1 and 2.

As the internal pressure in the container increases, the valve head 32 rises axially and expands radially, until it makes contact with the energizing ring 5, which supports the valve head 32 and restricts any further radial expansion. Stresses build up in the connecting wall 33 as it is forced against the energizing ring 5. These stresses provide the torque assist required to "flip" the valve head 32 to its partially inverted configuration, thereby opening the dispensing aperture 6 (as shown in FIG. 3B). The stresses built up in the connecting wall 33, also energise the valve 3 and provide a spring bias to snap the valve head 32 back to its concave, closed position, once the internal pressure in the container is relieved.

It will be readily apparent to those skilled in the art that the position and engagement of the energizing ring relative the self-closing valve may be varied to produce different opening/closing characteristics for the valve. Furthermore, the energizing ring may be applied to many other self-closing valve configurations than those shown in FIGS. 1, 2 and 3.

Although a preferred embodiment of the invention has been specifically illustrated and described herein, it is to be understood that minor variations may be made in the apparatus without departing from the spirit and scope of the invention, as defined by the appended claims.

What is claimed is:

1. A closure comprising a self-closing valve, said self-closing valve including a flexible valve wall of a substantially cup-shaped configuration in a first non-dispensing closed at-rest position thereof, said cup-shaped valve wall having a dispensing aperture therein which is closed in said at-rest position, the substantially cup-shaped valve wall being deflected to a second substantially fully inverted upwardly directed dispensing position in response to increased product pressure in a container during which the dispensing aperture is opened, said substantially cup-shaped valve wall being united to an outboard flexible peripheral connecting wall of a predetermined undistorted exterior surface configuration in the first non-dispensing closed at-rest position of said cup-shaped valve wall, an energizing ring having an inboard annular surface in contacting bearing engagement against said connecting wall undistorted exterior surface in said first non-dispensing closed at-rest position of said cup-shaped valve wall, said peripheral connecting wall being axially displaced from said first non-dispensing closed at-rest position to the second aperture open dispensing position at which the connecting wall exterior surface becomes outwardly distorted, and said energizing ring inboard annular surface remains in contacting bearing engagement against said connecting wall exterior surface between said axially displaced at-rest closed position and aperture open dispensing position of said valve wall.

2. The closure as defined in claim 1 wherein said flexible valve wall occupies a third position between said first and second positions at which said dispensing aperture is closed and said flexible valve wall includes a central wall portion bowed in a direction opposite to the opening direction of the cup-shaped valve wall in the first position.

3. The closure as defined in claim 2 wherein the peripheral connecting wall is of a substantially cylindrical configuration in said first position.

4. The closure as defined in claim 2 wherein the energizing ring is an unbroken annulus.

5. The closure as defined in claim 2 wherein the energizing ring is a segmented annulus.

6. The closure as defined in claim 2 wherein said peripheral connecting wall includes a lower radially outwardly directed connecting flange, said connecting flange is snap-secured between a pair of annular closure members, a first of said annular closure members is adapted to be connected to an associated container from which a product is to be dispensed, and a second of said annular closure members carries said energizing ring.

7. The closure as defined in claim 6 wherein the peripheral connecting wall is of a substantially cylindrical configuration in said first position.

8. The closure as defined in claim 6 wherein the energizing ring is an unbroken annulus.

9. The closure as defined in claim 6 wherein the energizing ring is a segmented annulus.

10. The closure as defined in claim 1 wherein the peripheral connecting wall is of a substantially cylindrical configuration in said first position.

11. The closure as defined in claim 1 wherein the energizing ring is an unbroken annulus.

12. The closure as defined in claim 1 wherein the energizing ring is a segmented annulus.

13. The closure as defined in claim 1 wherein said peripheral connecting wall includes a lower radially outwardly directed connecting flange, said connecting flange is snap-secured between a pair of annular closure members, a first of said annular closure members is adapted to be connected to an associated container from which a product is to be dispensed, and a second of said annular closure members carries said energizing ring.

* * * * *